US009757609B2

(12) United States Patent
Nishimura

(10) Patent No.: US 9,757,609 B2
(45) Date of Patent: Sep. 12, 2017

(54) ELECTROMECHANICAL DEVICE FOR SIMULATION OF PHYSICAL EXERCISES WITH LEGS AND ARMS

(76) Inventor: Key Nishimura, Saol Paula (BR)

( * ) Notice: Subject to any disclaimer, the term of this patent is extended or adjusted under 35 U.S.C. 154(b) by 582 days.

(21) Appl. No.: 13/488,614

(22) Filed: Jun. 5, 2012

(65) Prior Publication Data

US 2012/0322620 A1 Dec. 20, 2012

(30) Foreign Application Priority Data

Jun. 14, 2011 (BR) ..... 1102892

(51) Int. Cl.

| | |
|---|---|
| ***A63B 21/005*** | (2006.01) |
| ***A63B 24/00*** | (2006.01) |
| ***A63B 22/00*** | (2006.01) |
| ***A63B 21/015*** | (2006.01) |
| ***A63B 21/22*** | (2006.01) |
| ***A63B 22/06*** | (2006.01) |
| ***A63B 71/06*** | (2006.01) |

(52) U.S. Cl.

CPC ..... *A63B 22/001* (2013.01); *A63B 21/015* (2013.01); *A63B 21/225* (2013.01); *A63B 22/0058* (2013.01); *A63B 22/0664* (2013.01); *A63B 71/0619* (2013.01); *A63B 2071/0647* (2013.01); *A63B 2220/80* (2013.01)

(58) Field of Classification Search

USPC ..... 482/1, 6, 70, 51, 52, 71

See application file for complete search history.

(56) References Cited

U.S. PATENT DOCUMENTS

| | | | | |
|---|---|---|---|---|
| 5,769,760 | A * | 6/1998 | Lin et al. | 482/52 |
| 5,957,814 | A * | 9/1999 | Eschenbach | 482/51 |
| 5,993,359 | A * | 11/1999 | Eschenbach | 482/57 |
| 6,045,487 | A * | 4/2000 | Miller | 482/52 |
| 6,152,859 | A * | 11/2000 | Stearns | 482/52 |
| 6,168,552 | B1 * | 1/2001 | Eschenbach | 482/52 |
| 6,436,007 | B1 * | 8/2002 | Eschenbach | 482/52 |
| 6,440,042 | B2 * | 8/2002 | Eschenbach | 482/52 |
| 6,994,657 | B1 * | 2/2006 | Eschenbach | 482/52 |
| 7,104,929 | B1 * | 9/2006 | Eschenbach | 482/52 |
| 7,316,632 | B2 * | 1/2008 | Rodgers, Jr. | 482/52 |
| 7,608,018 | B2 * | 10/2009 | Chuang et al. | 482/52 |
| 7,811,206 | B2 * | 10/2010 | Chuang et al. | 482/52 |
| 7,862,482 | B1 * | 1/2011 | Hsu | 482/52 |
| 2001/0036886 | A1 * | 11/2001 | Eschenbach | 482/142 |
| 2006/0199702 | A1 * | 9/2006 | Eschenbach | 482/52 |
| 2007/0219062 | A1 * | 9/2007 | Rodgers | 482/52 |
| 2009/0105049 | A1 * | 4/2009 | Miller | 482/52 |
| 2009/0181828 | A1 * | 7/2009 | Rodgers, Jr. | 482/52 |

* cited by examiner

*Primary Examiner* — Sundhara Ganesan
*Assistant Examiner* — Shila Jalalzadeh Abyan
(74) *Attorney, Agent, or Firm* — Michael J. Striker

(57) ABSTRACT

An electromechanical device for simulation of physical exercise with legs and arms includes two pedals mounted on two contiguous pantographs, with parallel supporting arms that are positioned in a predominantly vertical sense, with an orthogonal junction and parallel arms which are articulated, in a predominantly horizontal sense, onto the frame of the device and which always move in opposing directions left and right, through traverses which are articulated on vertical and horizontal axles, respectively, connected to vertical and horizontal parallel bars by means of risers.

5 Claims, 10 Drawing Sheets

Section A-A

Section B-B

Section C-C

ELECTROMECHANICAL DEVICE FOR SIMULATION OF PHYSICAL EXERCISES WITH LEGS AND ARMS

CROSS-REFERENCE TO A RELATED APPLICATION

Figure 1:
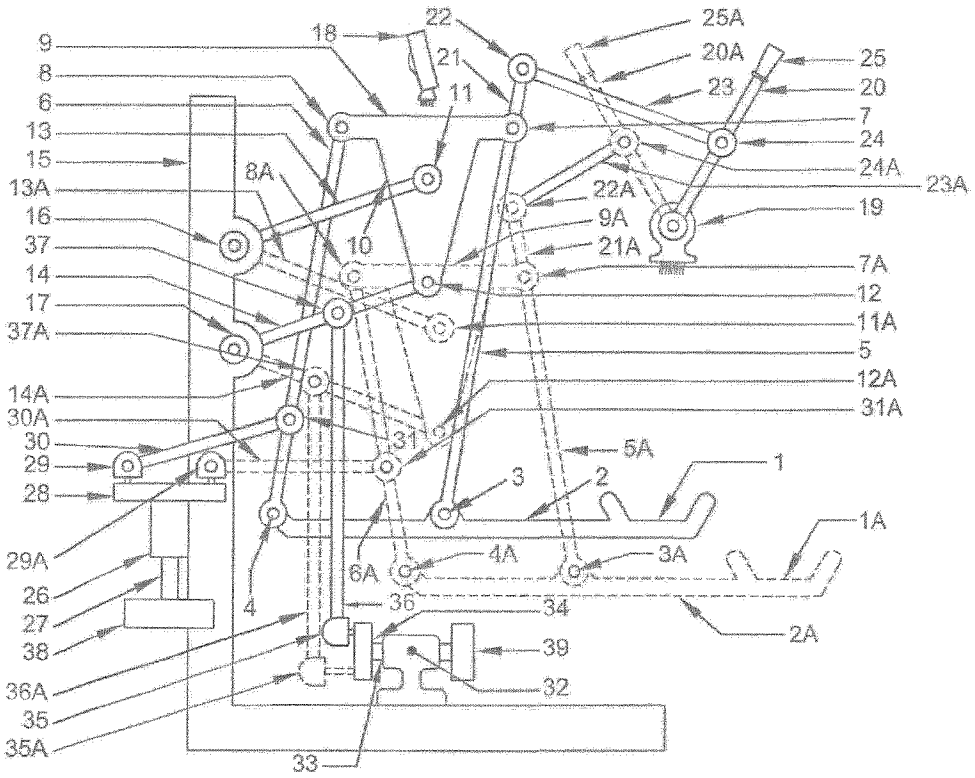

The invention described and claimed hereinbelow is also described in Brazilian Patent Application PI-1102892-0, filed on Jun. 14, 2011. The Brazilian Patent Application, whose subject matter is incorporated by reference herein, provides the basis for a claim of priority of invention under 35 U.S.C. 119(a)-(d).

BACKGROUND OF THE INVENTION

The present description relates to an electromechanical device for simulation of physical exercise with legs and arms, which allows for independent control of horizontal and vertical movements, as well as a combination of such movements.

Gym equipment for cardiovascular exercises in fitness studios seeks to simulate walking, running, climbing and arm movements, the majority of which typically include treadmills, stationary bikes, elliptical machines and stair machines. With the exception of treadmills, all the other aforementioned devices have braking systems that require users to exert effort.

Normally, the course or trajectory of the pedals and handlebars are fixed, and the range of motion is also fixed. Regulation of physical load is restricted to the braking system, with intensity controlled by use of a panel.

At the current time, the trend in physical fitness training demands changes in the trajectory of strides made by the user, in response to which more sophisticated machines are being built, so as to allow for changes in the range of motion and the incline of the course, as it relates to the horizontal plane.

Machines of the latest design have come to rely on independent horizontal displacement, without mechanism restrictions, so that the user can change the range of his or her muscular motion.

SUMMARY OF THE INVENTION

The present invention provides an electromechanical device for simulation of physical exercises with legs and arms that overcome shortcomings of the known arts.

The electromechanical device simulates physical exercise with legs and arms in a way that provides independent control of horizontal and vertical movements, and a combination of both, with the added feature of controlled loads in both directions and their combinations and monitoring of ranges of motion in order to provide information to a control panel where the parameters of exercise are shown on a screen, so that the power and exertional load are displayed and saved in memory.

The inventive electromechanical device provides the user with a choice of exercise by merely programming the energy output, thereby facilitating use of the device by athletes as well as the elderly and individuals undergoing rehabilitation.

In an embodiment, the invention provides an electromechanical device that simulates physical exercise with the legs and arms, of the type that contains a suspension for pedals, consisting of two pedals mounted on two contiguous pantographs, with parallel supporting arms positioned in a predominantly vertical direction, an orthogonal junction and parallel arms in a predominantly horizontal direction and articulated on a frame of the device, and always operating in opposition directions, moving to the left and the right through articulated traverses on axles, positioned vertically and horizontally, respectively, and connected to parallel horizontal and vertical bars by risers, such that angular movement of the traverses are transmitted to the electromagnetic brakes using a system of belts, pulleys and ratchets which transform the alternating angular motion into a rotating movement of the flywheels moving in a single direction and equipped with electromagnetic brakes and a control panel governing the braking system and the interpretation of sensors of the angular motion made by the traverses in order to transmit information to the user and to feed a display showing the recent course of movement of the pedals.

BRIEF DESCRIPTION OF THE DRAWING FIGURES

Figure 2:
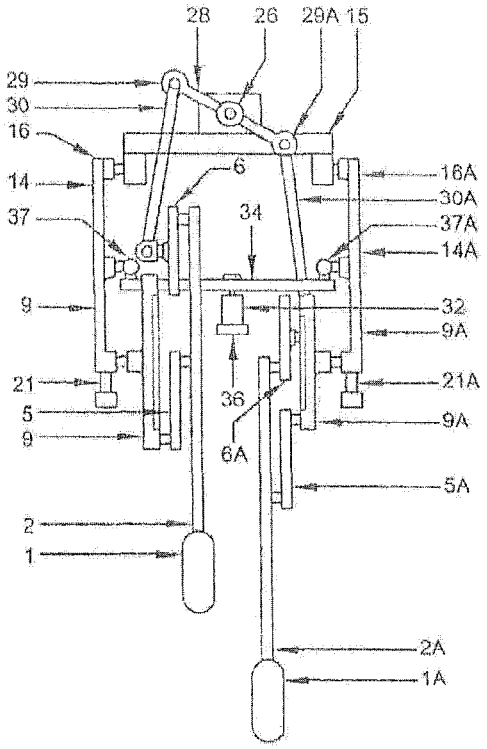
Figure 3:
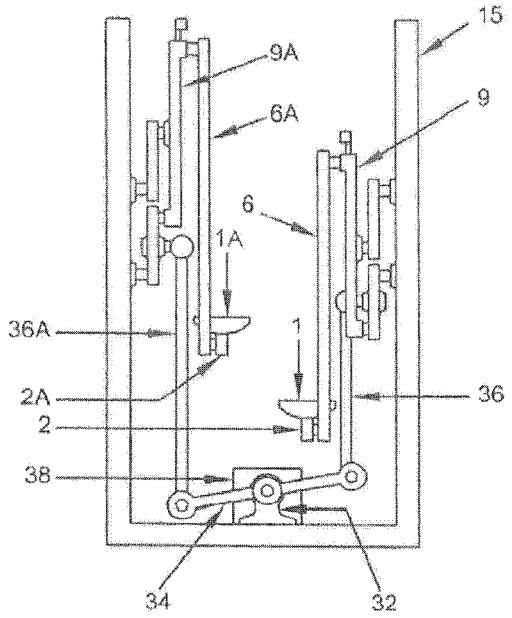
Figure 4:
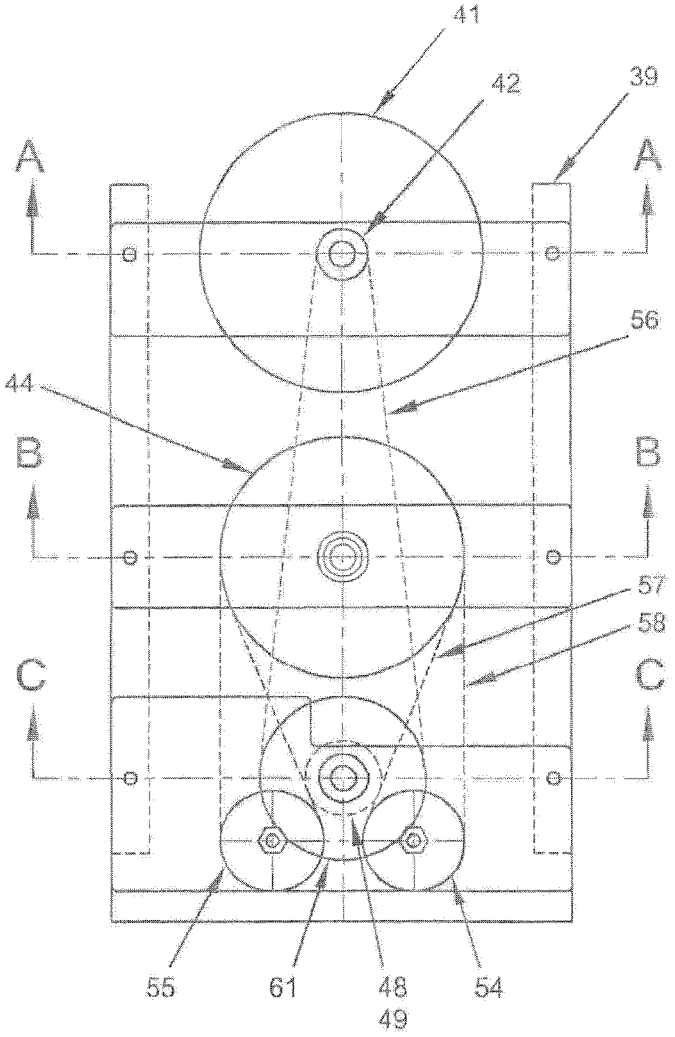
Figure 5:
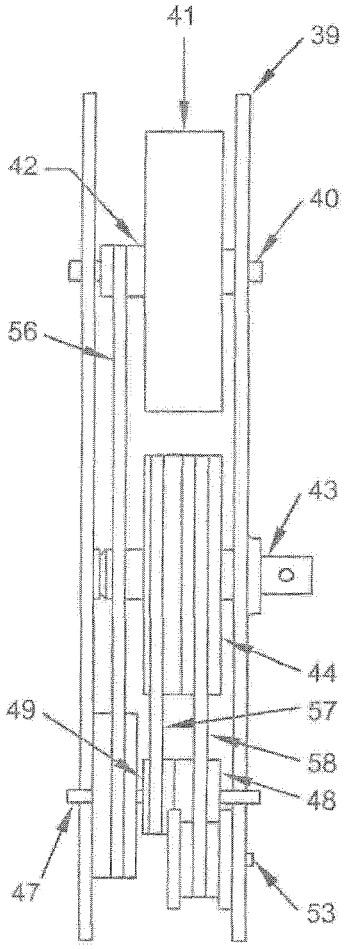
Figure 6:
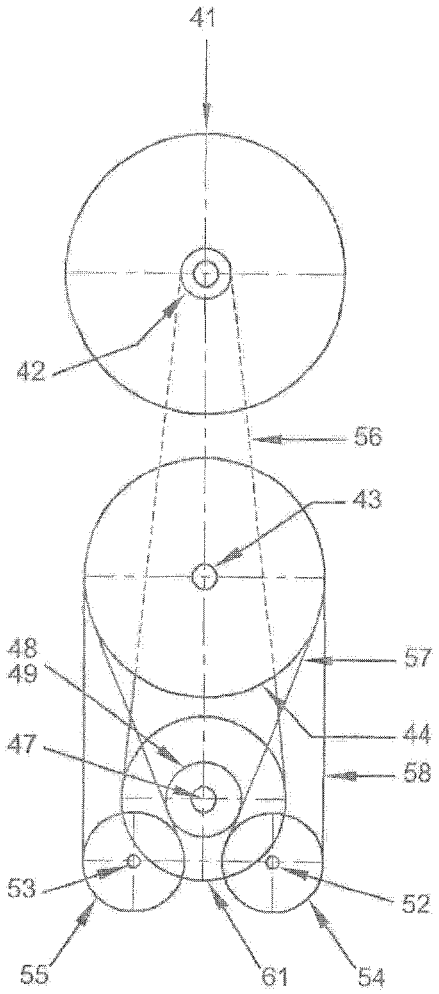
Figure 7:
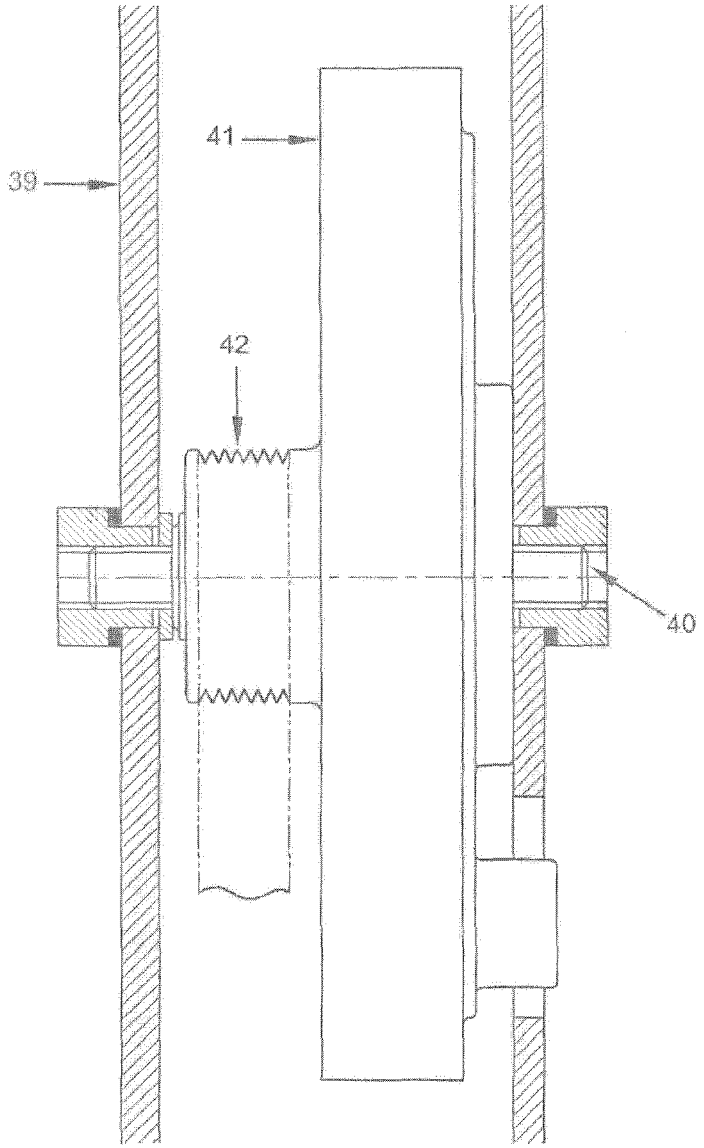
Figure 8:
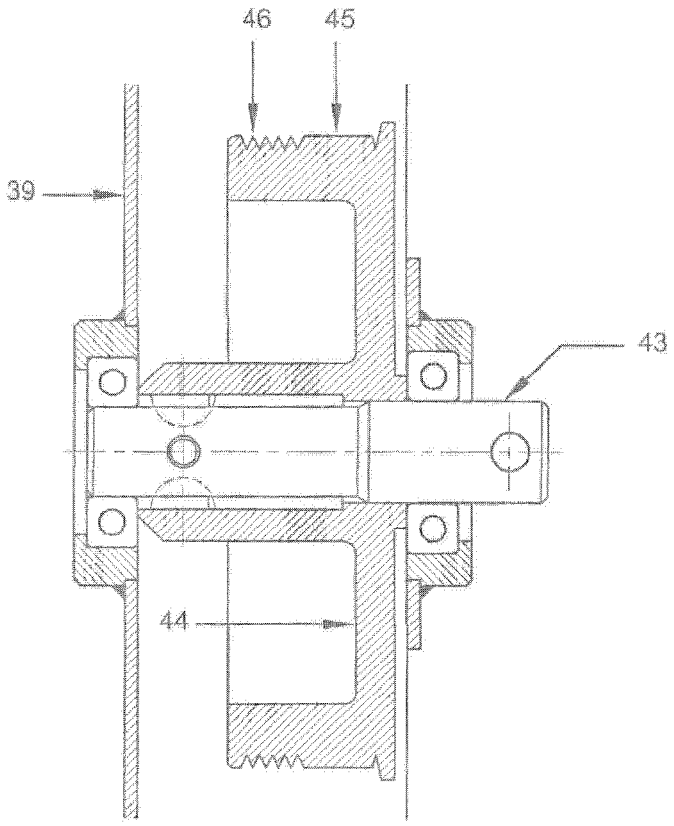
Figure 9:
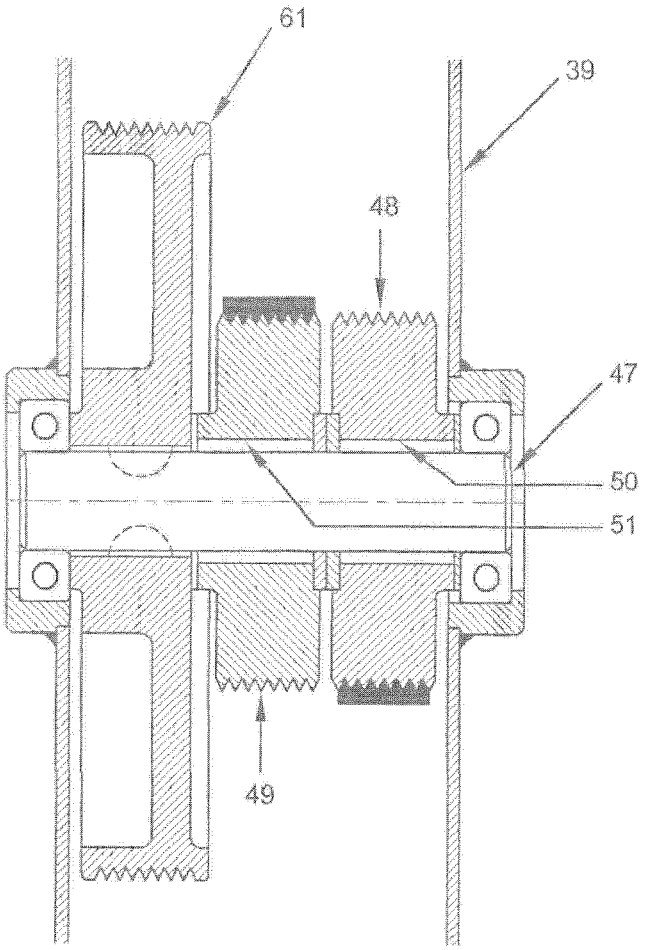
Figure 10:
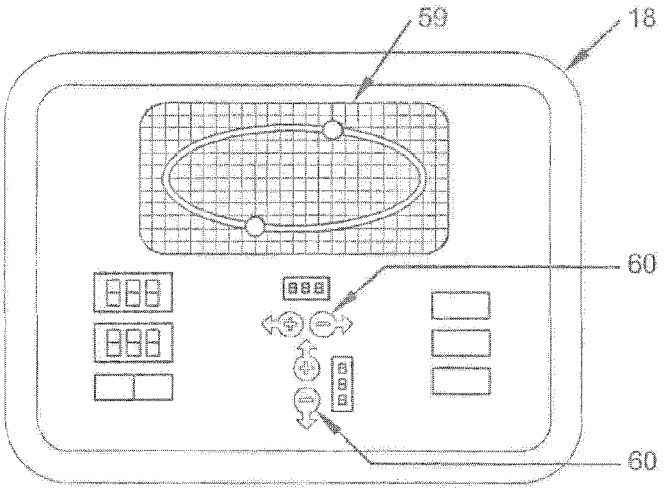
Figure 11:
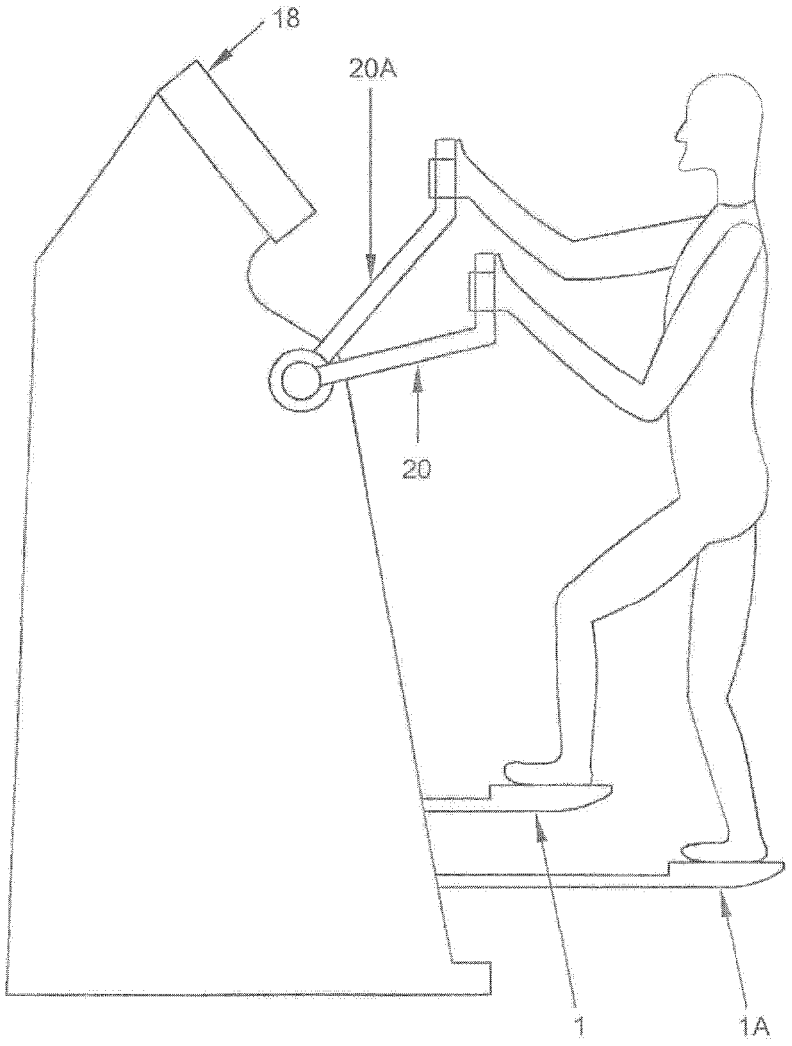

Further features and advantages of the invention will become apparent from the description of embodiments that follows, with reference to the attached figures, wherein:

FIG. 1 presents a side elevation view of the device for simulating physical exercise;

FIG. 2 presents a plan view of the device from above;

FIG. 3 presents a front view of the device;

FIG. 4 presents a plan flat view of the braking system included in the device;

FIG. 5 presents an elevational view of the braking system illustrated in FIG. 4;

FIG. 6 presents a schematic plan view of the transmission of the braking system illustrated in FIG. 4;

FIG. 7 presents a detailed cross-section view taken according to the "A-A" line in FIG. 4, illustrating an area around the magnetic brake;

FIG. 8 presents a detailed cross-section view taken according to the "B-B" line in FIG. 4, and illustrating an area around a driver pulley;

FIG. 9 presents a cross-section detail, taken according to the "C-C" line in FIG. 4 and illustrating the area around the axle with three pulleys;

FIG. 10 presents a frontal view of the control and monitoring panel of the device; and FIG. 11 presents a side elevation view of the device covered by the exterior casing and with a user.

DETAILED DESCRIPTION OF THE PREFERRED EMBODIMENTS

The following is a detailed description of example embodiments of the invention depicted in the accompanying drawings. The example embodiments are presented in such detail as to clearly communicate the invention and are designed to make such embodiments obvious to a person of ordinary skill in the art. However, the amount of detail offered is not intended to limit the anticipated variations of embodiments; on the contrary, the intention is to cover all modifications, equivalents, and alternatives falling within the spirit and scope of the present invention, as defined by the appended claims.

According to FIGS. 1-11, the inventive electromechanical device for simulating physical exercise, the subject of the present invention, consists of two sets of parallel pantographs, each one comprised of one pedal 1 at the end of one horizontal bar 2, which is equipped, at opposite ends, with articulations 3 and 4, which are suspended on the lower ends of parallel connecting rods 5 and 6, on whose upper ends are attached articulations 7 and 8 with one junction 9, which has a vertical extension 10 provided with two articulations 11 and 12, one above the other. Mounted on these articulations are the ends of two parallel arms 13 and 14, which extend around to the back of the device, where columns on a frame 15 are found, the back ends of arms 13 and 14 being mounted on articulations 16 and 17.

FIG. 1 shows the pantographic set described above, as well as a parallel pantographic set, where the letter "A" is added to the numbers assigned to the various parts, in order to make it easier to understand the device.

Also for the purpose of simplifying the diagram, control and monitoring panel 18 shows just the symbols for mechanisms of attachment to the frame of the machine, as well as bearing 19 of moveable arms 20 and 20A.

Connecting rods 5 and 5A have extensions 21 and 21A above the upper articulations 7 and 7A, where articulations 22 and 22A are located, with risers 23 and 23A on the respective ends of which are found articulations 24 and 24A with moveable arms 20 and 20A, on the upper part of which are located handlebars 25 and 25A, so that the user can hold onto them with his or her hands.

Both pantographs move in opposing directions, both in a vertical and a horizontal sense.

In order to move horizontally, the frame 15 of the device receives a bearing 26 of vertical axle 27, with a traverse 28 joined onto it in the center and with spherical articulations 29 and 29A, which serve as bearings for both risers 30 and 30A, which are mounted on opposite ends of two articulations 31 and 31A, located on connecting rods 6 and 6A above articulations 4 and 4A.

In order to move vertically, the lower part of frame 15 has a bearing 32 on horizontal axle 33, which rotates a traverse 34 in the center, on whose ends are located two articulations 35 and 35A of two risers 36 and 36A, which face upwards, mounted on articulations 37 and 37A of arms 14 and 14A.

The movements of traverses 28 and 34 will be angular and limited, and can be stopped, to require the user to exert energy by means of two electromagnetic braking systems 38 and 39, which are conducted through axles 27 and 33 of the traverses.

FIG. 2 shows a simplified view of the device from above, in order to better understand the pantographs, by removing moveable arms 20 and its respective attachments and also by removing panel 18 and part of frame 15. In this way, traverses 28 and 34 and their risers 30 and 36, which are responsible for allowing the pantographs to move in opposite directions, can be seen more clearly.

FIG. 3 is also simplified, by eliminating certain components, such as the panel, moveable arms 20, bearing 26, traverse 28 and its respective attachments, so as to make it easier to see the inversion mechanism by which the vertical movements are made.

Each braking system 38 and 39 can produce resistance against the angular movement created by the horizontal and vertical displacement of pedals 1 and 1A. The movements are angular and alternating and can be converted into a single-directional rotating motion, so that the magnetic brakes can be activated in a regular pattern of rotation, thus creating effective resistance.

The electromagnetic braking system is illustrated schematically in this way, as shown in FIGS. 4, 5, 6, 7, 8, and 9. This electromagnetic braking system 39 comprises a structure in the form of a box with 5 parallel axles, of which the first axle 40 consists of a flywheel axle 41 of the conventional magnetic brake type, with an internal electrical conductor track across from a row of permanent magnets of alternating polarity and with a driver pulley controlled on panel 18. This flywheel has a small pulley 42. The mounting assembly of this part is shown in detail in FIG. 7.

The second axle 43 is a continuation of axle 27 or 33 of traverse 28 or 34, this component, in addition, being equipped with a double pulley 44 inside the structure of the electromagnetic braking system 39 and possessing two tracks 45 and 46 for use with belts, whether smooth or grooved. The assembly of this part is shown in detail in FIG. 8.

The third axle 47 has three pulleys, 48, 49, and 50. Pulleys 48 and 49 are identical and are mounted on axle 47 by means of inverted ratchets 50 and 51. This assembly is illustrated more clearly in FIG. 9.

The fourth and fifth axles 52 and 53 are located on the sides of axle 47 and are equipped with independent pulleys 54 and 55 in order to displace the belt, as seen in FIG. 6.

FIGS. 4 and 6 show the position of axles 52 and 53 in relation to the other components.

In order to enable the pulleys to move, use is made of three belts that are mounted. This assembly can be seen in FIGS. 4, 5 and 6. Belt 56 of the brake passes through pulley 42 and extends until pulley 61. Belt 57 passes through track 46 of pulley 44 until reaching pulley 49 of axle 47. Belt 58 passes through track 45 of pulley 44, extends around pulleys 54 and 55, with a 180° inversion, and returns back to run through pulley 48 of axle 47.

All axles 42, 43, 47, 52 and 53 are mounted on bearings in the structure of the electromagnetic braking system 39.

Axle 43 only allows for angular movements, transmitted through traverses 28 and 34 and their axles 27 and 33.

Using belts 57 and 58, these movements make pulleys 48 and 49 spin in opposite directions. These pulleys transmit movement through axle 47, always in the same direction of rotation, through inverted ratchets 50 and 51, as seen in FIG. 9. Thus, pulley 61 only turns in the same direction and increases its angular speed, transmitted by belt 56 to small pulley 42 of the electromagnetic brake.

The gym device is equipped with two brake sets, in order to allow for vertical and horizontal movements or a combination of such movements.

Angular movement sensors may be placed on the electromagnetic brakes, on axles 43 or on pulleys 44 in order to detect maximum extent of movement.

Information about the level of resistance and of the range of motion is sent to control and monitoring panel 18. This panel integrates these data with [the variable of] time and can therefore inform the user about cadence, power, calories expended and can track the ongoing progress of a pedal on display 50. The control panel is equipped with keys 60 to increase or decrease levels of resistance. The control panel is also equipped with inputs for electronic devices which are configured to accept past recorded data as well as pre-stored settings that have been preset for the user from a memory device The user may also exercise his arms through forced movements driven by handlebars 25 and 25A on moveable arms 20 and 20A.

Without activating the brakes, the movement of pedals 1 is absolutely free, both forwards and backwards, including all possible combinations of such movements.

In terms of output of energy, the brakes can be selectively activated on control panel 18.

Any user, in whatever arrangement, whether young or old, healthy or undergoing physical rehabilitation, may be able to use this device, since the movements are free and braking is load-dependent, but it is also dependent on cadence.

As will be evident to persons skilled in the art, the foregoing detailed description and figures are presented as examples of the invention, and that variations are contemplated that do not depart from the fair scope of the teachings and descriptions set forth in this disclosure. The foregoing is not intended to limit what has been invented, except to the extent that the following claims so limit that.

What is claimed is:

1. An electromechanical device for physical exercise simulation comprising:

a frame, the frame comprises a back frame and a bottom frame, said back frame extending vertically from one end of the bottom frame;

a first contiguous pantograph set comprising:

a first support bar having a first pedal;

a first and a second elongated connecting rod, each of said first and second elongated connecting rods having a first end and a second end, the first end of said first elongated connecting rod is pivotally connected to a mid-section of the first support bar and the first end of said second elongated connecting rod is pivotally connected to an end of the first support bar, wherein said first and second elongated connecting rods are positioned vertically and parallel to each other;

a second contiguous pantograph set comprising:

a second support bar having a second pedal;

a third and a fourth elongated connecting rod, each of said third and fourth elongated connecting rods having a first end and a second end, the first end of said third elongated connecting rod is pivotally connected to a mid-section of the second support bar and the first end of said fourth bar, wherein said third and fourth elongated connecting rods are positioned vertically and parallel to each other;

a first, vertically positioned, junction member, the first junction member comprises a first pair of extensions extending horizontally and in opposite directions from the first junction member, wherein the second end of said second elongated connecting rods is pivotally connected to one extension of said first pair of extensions and the other extension of said first pair of extensions is pivotally connected to the first elongated connecting rod at a location near the second end of said first elongated connecting rod;

a second, vertically positioned, junction member, the second junction member comprises a second pair of extensions extending horizontally and in opposite directions from the second junction member, wherein the second end of said fourth elongated connecting rod is pivotally connected to one extension of said second pair of extensions and the other extension of said second pair of extensions is pivotally connected to the third elongated connecting rod at a location near the second end of said third elongated connecting rod;

a first pair of parallel arms, said first pair of parallel arms comprises a first substantially horizontal arm positioned above a second substantially horizontal arm, each of said first and second substantially horizontal arms having two opposite ends, wherein each of said first and second substantially horizontal arms is pivotally coupled to the first junction member at one end and pivotally coupled to the back frame at the other end;

a second pair of parallel arms, said second pair of parallel arms comprises a third substantially horizontal arm positioned above a fourth substantially horizontal arm, each of said third and fourth substantially horizontal arms having two opposite ends, wherein each of said third and fourth substantially horizontal arms is pivotally coupled to the second junction member at one end and pivotally coupled to the back frame at the other end;

a first traverse having a vertical axle mounted on a first bearing, the first bearing being affixed to the back frame, and a second traverse having a horizontal axle mounted on a second bearing, the second bearing being affixed to the bottom frame;

a first electromagnetic brake connected to the first bearing, and a second electromagnetic brake connected to the second bearing;

a first riser and a second riser, each having two ends, wherein one end of the first riser is pivotally coupled to the second elongated connecting rod and the other end of the first riser is pivotally coupled to the first traverse, and wherein one end of the second riser is pivotally coupled to the fourth elongated connecting rod and the other end of the second riser is pivotally coupled to the first traverse at the other end; and a pair of vertical links, each having two ends, wherein the vertical links are pivotally connected to the second traverse at one of said two ends, and pivotally connected to the second and fourth substantially horizontal arms at the other one of said two ends, respectively.

2. The electromechanical device according to claim 1, wherein each of the first and the second electromagnetic brakes has a box structure with first, second, third, fourth and fifth parallel axles;

wherein the first, second and third of the parallel axles are arranged in a row and the fourth and the fifth of the parallel axes are each placed towards one side of the third parallel axle, respectively, thereby forming three sets of transmissions;

wherein the first transmission set of each of the first and second electromagnetic brake is formed by the first parallel axle; comprising of a flywheel axle and an internal electrical conductor track arranged across from a row of permanent magnets with alternating polarities;

wherein the flywheel axle has a small pulley;

wherein the second transmission set of each of the first and second electromagnetic brake is formed by the second parallel axle, and externally fastened with horizontal axle of the second traverse or with vertical axle of the first traverse; and wherein a third transmission set of each of the first and second electromagnetic brake is formed internally of a plurality of pulleys interconnected with each other and with the other two transmission sets by a first, a second and a third belt, respectively.

3. The electromechanical device according to claim 2, wherein each of the first and the second electromagnetic brakes further has one double pulley inside the box structure with at least two tracks, wherein the third parallel axle supports the plurality of pulleys comprising first, second and third pulleys, the first and second pulleys are identical and mounted on the third axle using two inverted ratchets, and the third pulley is attached to the third parallel axle and receives the first belt, which runs up to the small pulley, and wherein both of fourth and fifth parallel axes are each mounted on a side of the third axle and with first and second independent pulleys, wherein the first and second independent pulleys can move freely, with the second belt on one track of the at least two tracks of the double pulley, passing around the first and second independent pulleys, with a displacement of 180 degrees, and returning to pass around the first pulley of the third parallel axle, and wherein the third belt mounted on another track of the at least two tracks of the double pulley and the second pulley of the third axle.

4. The electromechanical device according to claim 1, further comprising first and second moveable arms pivotally mounted on a third bearing attached the frame, wherein the first and second moveable arms are provided at a top with respective handlebars, and are each pivotally connected, at a midpoint, to one end of a movable link, respectively, wherein the other end of each movable link is pivotally connected to the second end of the first and third elongated connecting rods.

5. The electromechanical device according to claim 1, further comprising a control and monitoring panel attached to the frame and configured to control the first and the second electromagnetic brakes, wherein the control and monitoring panel receives user input to increase or decrease braking levels and receives sensor signals tracking angular movement of each double pulley, in order to integrate a variable of time and provide the user with one or more data selected from a group consisting of: calories spent, cadence and power, and display a recent course recorded of strides of each of the first and second pedals.

* * * * *